US006227205B1

(12) United States Patent
Metzner et al.

(10) Patent No.: US 6,227,205 B1
(45) Date of Patent: May 8, 2001

(54) METHOD FOR TREATMENT OF TOBACCO FINE CUT

(75) Inventors: Wolfgang Metzner, Bindlach; Uwe-Peter Körner, Neuenmarkt, both of (DE)

(73) Assignee: Brown & Williamson Tobacco Corporation, Louisville, KY (US)

( * ) Notice: Subject to any disclaimer, the term of this patent is extended or adjusted under 35 U.S.C. 154(b) by 0 days.

(21) Appl. No.: 09/197,929

(22) Filed: Nov. 23, 1998

(30) Foreign Application Priority Data

Dec. 17, 1997 (DE) ..... 197 56 217

(51) Int. Cl.[7] ..... A24B 3/04

(52) U.S. Cl. ..... 131/300; 131/290; 131/311; 131/291; 131/306

(58) Field of Search ..... 131/290, 311, 131/300, 306, 291

(56) References Cited

U.S. PATENT DOCUMENTS 4,054,145 * 10/1977 Berndt et al. ..... 131/306
5,139,035 * 8/1992 Lasch et al. ..... 131/299
5,143,095 * 9/1992 Lasch et al. ..... 131/290
5,299,583 * 4/1994 Lasch et al. ..... 131/306
5,722,431 * 3/1998 Metzner et al. ..... 131/290
5,799,665 * 9/1998 Cho et al. ..... 131/291
5,813,413 * 9/1998 Metzner et al. ..... 131/290
5,826,590 * 10/1998 Metzner et al. ..... 131/290

FOREIGN PATENT DOCUMENTS 0388673 9/1990 (EP) .
0388793 9/1990 (EP) .
0651951 5/1995 (EP) .
0774212 5/1997 (EP) .
1089361 11/1967 (GB) .
WO 94/10864 5/1994 (WO) .

OTHER PUBLICATIONS

Voges, Ernst, Tobacco Encyclopedia, Mainz, Mainzer Verlagsanstalt and Druckerei, 1984, p. 432.

* cited by examiner

*Primary Examiner*—James Derrington
(74) *Attorney, Agent, or Firm*—John F. Salazar; Middleton & Reutlinger

(57) ABSTRACT

The invention relates to a method of treating tobacco fine cut in which the cut tobacco is preheating and moistening is moistened to a moisture content of a maximum of 18 to 18.5%, after which it is supplied without any further drying to a screening and cooling step resulting in a moisture content of a maximum of 17–17.5%.

12 Claims, 1 Drawing Sheet

METHOD FOR TREATMENT OF TOBACCO FINE CUT

BACKGROUND OF THE INVENTION

1. Field of the Invention

The invention relates to a method of treating tobacco fine cut. Tobacco fine cut is a grade or blend of tobacco sold in pouches or cans for individual production of cigarettes by rolling or plugging. For this final application the final cut is usually treated substantially in the following steps:

moistening and casing (saucing) the tobacco to obtain a moisture content of approximately 18%, cutting the tobacco at a moisture content of approximately 18%, conditioning the tobacco to obtain a moisture content of approximately 24%, drying the tobacco in a separate dryer to obtain a moisture content of approximately 17.5%, screening and cooling the tobacco to obtain a moisture content of approximately 16.5%, flavoring the tobacco.

2. Description of the Related Art

In prior art the tobacco is rendered very moist (24% moisture content) in the conditioning step. In the final product the moisture content of the fine cut must not exceed a maximum of 17.5 since any higher moisture content may lead to problems, especially where lengthy shipping and storage are involved.

For the above reasons known fine cut treatment methods make use of a dryer with the aid of which the tobacco moisture content is reduced to a value of around 17%.

Employing a dryer, however, has unfavorable effects on the tobacco. Due to the tobacco fibers of the fine cut being longer as a rule than in cut tobacco for machine-produced cigarettes it has a greater tendency to tangle which in part cannot be untangled in the dryer.

Those tobacco tangles fail to be adequately dried out in their interior sections which may result in a non-homogeneous moisture content throughout the final product.

In addition to this, the tobacco, when excessively dried loses desired aroma substances which may need to be refurbished later on.

SUMMARY OF THE INVENTION

The object of the present invention is to provide a method of treating tobacco fine cut which obviates the aforementioned problems, it more particularly being the intention to provide an uncomplicated method for producing a smooth, loose tobacco having a consistent moisture content without lumping.

This object is achieved in accordance with the invention by a method of treating tobacco fine cut involving the following steps:

a) moistening and casing (saucing) the tobacco;
b) cutting the tobacco:
c) preheating and moistening the tobacco;
d) screening and cooling the tobacco;
e) flavoring the tobacco, wherein the cut tobacco is moistened in step c) to a moisture content of a maximum of 18 to 18.5% before being supplied without any further drying to the screening and cooling (step d), after which it has a moisture content of a maximum of 17–17.5%.

Due to the slight increase in moisture content (from approximately 17.5% to 18 to 18.5%) during preheating no major drying is needed in the further steps of the method to attain a desired low final moisture content, i.e. there now being no need to use a dryer involving the aforementioned negative effects and which in addition has a highly energy consumption. After preheating and moistening, the fine cut may be forwarded directly to the screening and cooling step which then furnishes the desired final moisture content.

The resulting fine cut comprises as the final product no lumping or hardening, i.e. nests of tobacco, it instead being smooth and loose. Desired aroma substances which are otherwise lost in drying are still present in the tobacco after treatment in accordance with the invention.

A further method in accordance with the invention for treating tobacco fine cut comprises the following steps:

a) moistening and casing (saucing) the tobacco with the addition of the flavoring;
b) cutting the tobacco;
c) preheating and moistening the tobacco;
d) screening and cooling the tobacco;

wherein the cut tobacco is moistened in step c) to a moisture content of a maximum of 18 to 19% before then being supplied without any further drying to the screening and cooling (step d), after which it has a moisture content of a maximum of 17–17.5%.

This method eliminates a separate drying step as opposed to the prior art with the advantages achievable as listed above. A further advantageous aspect of the configuration is evident from the fact that flavoring can now be done in an early stage in the method, as is done in this case by casing (saucing), which was impossible in conventional methods involving heavy drying since the flavorants would have escaped from the fine cut in drying.

Accordingly, by the variant of the method in accordance with the invention as cited above, the flavoring step may be combined early in the process, this combination making it possible to save a separate step in the method, thus enhancing the freedom in configuring the product within the treating method.

In a method in accordance with the invention tobacco of a single grade or blended may be processed.

In accordance with one embodiment of the method of the invention the tobacco is cut to a cutting width of approximately 0.4 mm to approximately 0.5 mm, preferably 0.45 mm.

The screening and cooling step is implemented in a cooling and screening drum. Should a separate drum be employed having few obliquely inclined and short tumbling plates for a gentle treatment of the tobacco, i.e. the cooling performance of which is somewhat less, the tobacco may be deposited on a cooling belt after having passed through the screening drum.

BRIEF DESCRIPTION OF THE DRAWINGS

The invention will now be discussed in more detail on the basis of the accompanying illustration. This illustration shows flow diagrams of the salient steps of a fine cut treating method in accordance with prior art and in accordance with two variants in accordance with the invention, depicted side by side.

DESCRIPTION OF THE PREFERRED EMBODIMENTS

Figure 1:
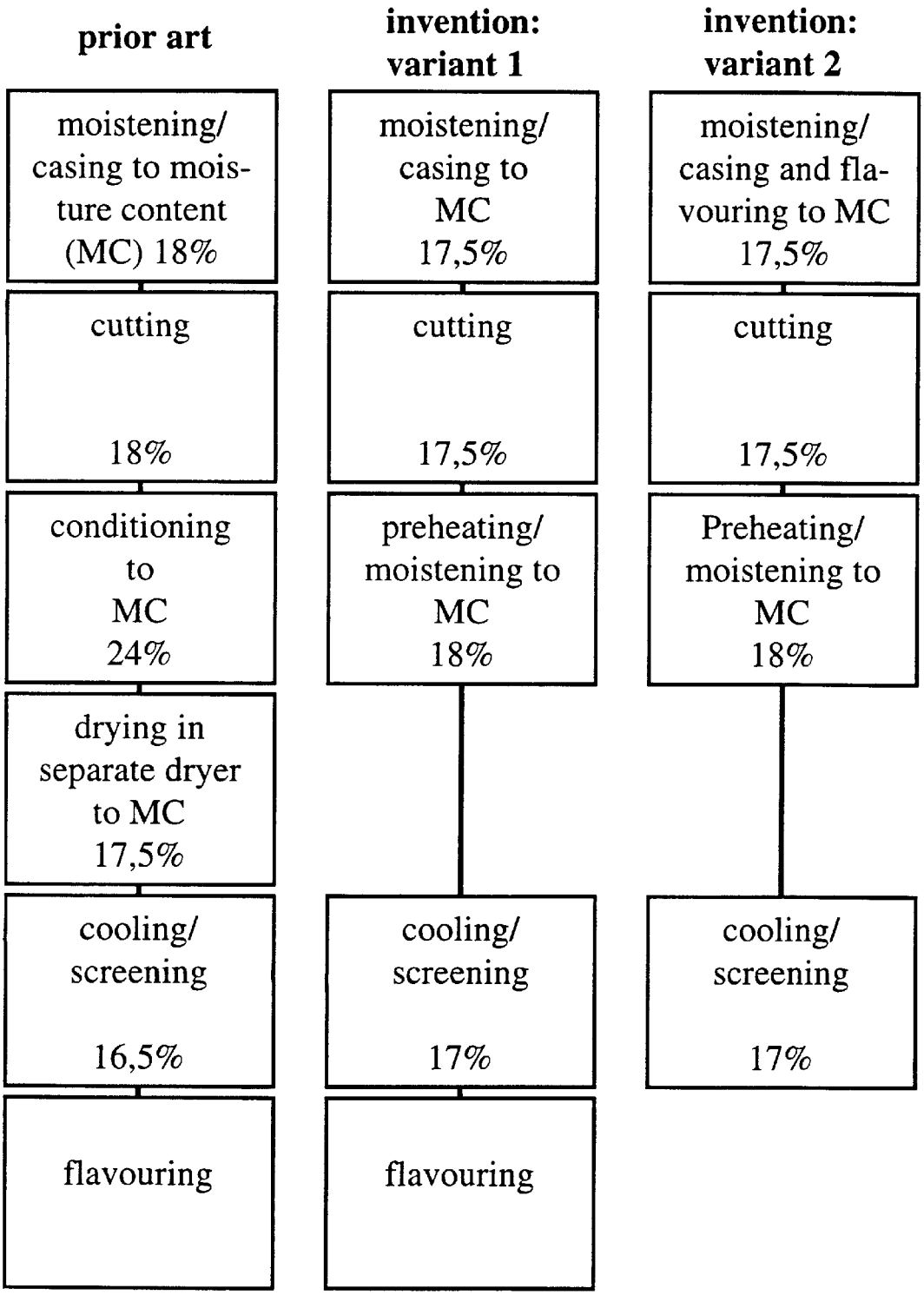

Shown on the left in the illustration is firstly a comparative method in accordance with prior art, tested for use in fine cut treating, involving moistening and casing (saucing) the tobacco to obtain a moisture content of approximately 18%, cutting the tobacco at a moisture content of approximately 18%, conditioning the tobacco to obtain a moisture content of approximately 24%, drying the tobacco in a separate dryer to obtain a moisture content of approximately 17.5%, screening and cooling the tobacco to obtain a moisture content of approximately 16.5% and in conclusion flavoring the tobacco.

The fine cut produced as such contained tobacco nests and was shaggy in texture.

Shown in the middle of the illustration is a flow diagram of the embodiment 1 of treating method in accordance with the invention as implemented in testing, involving moistening and casing (saucing) the tobacco to obtain a moisture content of 17.5%, cutting the tobacco, preheating and moistening the tobacco to obtain a moisture content of 18%, screening and cooling the tobacco to obtain a moisture content of 17% and in conclusion flavoring the tobacco.

The drying step was omitted, it not being necessary due to the residual moisture after preheating and moistening being slight.

The resulting fine cut was smooth and loose, free of any hardenings or tobacco nests, i.e. pouching was possible with no problem.

The test according to embodiment 1 was carried out for two different blends of tobacco, the above advantageous result being achieved for both. Even a blend having a 10% stem proportion could be processed with the same success.

Shown on the right of the illustration is a flow diagram of the embodiment 2 of the treating method in accordance with the invention as implemented in testing, involving moistening and casing (saucing) of the tobacco to obtain a moisture content of 17.5% including flavoring; cutting the tobacco, preheating and moistening the tobacco to obtain a moisture content of 18%, and finally, screening and cooling the tobacco to obtain a moisture content of 17%.

Here to, the drying step was omitted, it being unnecessary due to the low moisture content after preheating and moistening. Flavoring was implemented together with moistening and casing (saucing), thus saving the last step as needed in embodiment 1.

Here again, the resulting fine cut was smooth and loose, free of any hardenings or tobacco nests, and in this case to, pouching presented no problem.

The cutting width of all samples was 0.45 mm.

It will be appreciated that "shifting" the flavoring step to the moistening/casing step represents but one example for the alternatives in configuring the method in accordance with the invention. Accordingly, all steps in the prior art methods needing to be implemented at a specific point in time due to the drying may now be timed as needed with greater freedom in accordance with the present invention.

What is claimed is:

1. A method of treating tobacco consisting essentially of fine-cut or a blend of fine-cut with up to 10% stem portion comprising sequentially the steps:

(a) moistening and casing the tobacco;

(b) cutting the tobacco;

(c) preheating and moistening the tobacco;

(d) screening and cooling the tobacco;

(e) flavoring the tobacco wherein the cut tobacco is moistened in step (c) to a moisture of a maximum of 18 to 18.5% before being supplied without any further drying in a dryer to the screening and cooling step (step d), after which it has a moisture content of a maximum of 17–17.5%.

2. A method of treating tobacco consisting essentially of fine-cut or a blend of fine-cut with up to 10% stem portion comprising sequentially the steps:

(a) moistening and casing the tobacco with the addition of flavor;

(b) cutting the tobacco;

(c) preheating and moistening the tobacco;

(d) screening and cooling the tobacco;

wherein the cut tobacco is moistened in step (c) to a moisture content of a maximum of 18 to 19% before being supplied without any further drying in a dryer to the screening and cooling step (step d) after which it has a moisture content of a maximum of 17–17.5%.

3. The method as set forth in claim 1, wherein a tobacco blend is processed.

4. The method as set forth in claim 2, wherein a tobacco blend is processed.

5. The method as set forth in claim 1, wherein the tobacco is cut to a cutting width of 0.3 mm to 0.7 mm.

6. The method as set forth in claim 2, wherein the tobacco is cut to a cutting width of 0.3 mm to 0.7 mm.

7. The method as set forth in claim 5, wherein the tobacco is cut to a cutting width of 0.4 mm to 0.5 mm.

8. The method as set forth in claim 6, wherein the tobacco is cut to a cutting width of 0.4 mm to 0.5 mm.

9. The method as set forth in claim 1, wherein the step of screening and cooling is implemented in a cooling and screening drum.

10. The method as set forth in claim 2, wherein the step of screening and cooling is implemented in a cooling and screening drum.

11. The method as set forth in claim 9, wherein the tobacco after having passed through the cooling and screening drum is deposited on a cooling belt.

12. The method as set forth in claim 10, wherein the tobacco after having passed through the cooling and screening drum is deposited on a cooling belt.

* * * * *

UNITED STATES PATENT AND TRADEMARK OFFICE

CERTIFICATE OF CORRECTION

PATENT NO. : 6,227,205 B1
DATED : May 8, 2001
INVENTOR(S) : Metzner et al.

It is certified that error appears in the above-identified patent and that said Letters Patent is hereby corrected as shown below:

Title page,
Item [57], ABSTRACT,
Line 2, delete "preheating and moistening is moistened" and insert
-- preheated and moistened --;

Column 3,
Line 44, delete "to" and insert -- too --.

Signed and Sealed this

Eleventh Day of November, 2003

JAMES E. ROGAN
*Director of the United States Patent and Trademark Office*